US009891557B2

(12) United States Patent
Takatsuka

(10) Patent No.: US 9,891,557 B2
(45) Date of Patent: Feb. 13, 2018

(54) IMAGE FORMATION APPARATUS HAVING INTERMEDIATE TRANSFER BELT SPEED CONTROL

(71) Applicant: Oki Data Corporation, Tokyo (JP)

(72) Inventor: Ryo Takatsuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/259,166

(22) Filed: Sep. 8, 2016

(65) Prior Publication Data

US 2017/0075261 A1 Mar. 16, 2017

(30) Foreign Application Priority Data

Sep. 15, 2015 (JP) ..... 2015-181972

(51) Int. Cl.
*G03G 15/16* (2006.01)
*G03G 15/00* (2006.01)

(52) U.S. Cl.
CPC ..... *G03G 15/1615* (2013.01); *G03G 15/6517* (2013.01); *G03G 15/6564* (2013.01); *G03G 2215/00949* (2013.01)

(58) Field of Classification Search
USPC ..... 399/66, 297–303
See application file for complete search history.

(56) References Cited

U.S. PATENT DOCUMENTS 8,335,446 B2 * 12/2012 Kobayashi ..... G03G 15/0178 399/301
8,346,111 B2 * 1/2013 Maehata ..... G03G 15/0131 347/116
8,712,299 B2 * 4/2014 Sugita ..... G03G 15/0131 347/116
9,104,127 B2 * 8/2015 Yamaguchi ..... G03G 15/5054
2014/0044460 A1 * 2/2014 Kudo ..... G03G 15/5054 399/301
2014/0334855 A1 * 11/2014 Onishi ..... G03G 15/1615 399/301

FOREIGN PATENT DOCUMENTS

JP 2010-277038 A 12/2010

* cited by examiner

*Primary Examiner* — Hoan Tran
(74) *Attorney, Agent, or Firm* — Metrolexis Law Group, PLLC

(57) ABSTRACT

An image formation apparatus includes: an intermediate transfer belt that carries and conveys a developer image formed by an image formation section; a driver that conveys the intermediate transfer belt in a predetermined direction; a transfer device that transfers the developer image carried on the intermediate transfer belt onto a predetermined medium; a first detector that detects a belt conveyance speed, which is the speed of the intermediate transfer belt conveyed; a controller that controls the driver; a conveyer section that conveys the medium to the transfer device; and a second detector that detects a medium conveyance speed, which is the speed of the medium conveyed by the conveyer section. The controller controls driving of the driver on the basis of the belt conveyance speed and the medium conveyance speed.

13 Claims, 9 Drawing Sheets

CONFIGURATION OF IMAGE FORMATION APPARATUS ACCORDING TO FIRST EMBODIMENT

CONFIGURATION OF IMAGE FORMATION APPARATUS ACCORDING TO FIRST EMBODIMENT

CONFIGURATION OF PRIMARY TRANSFER SECTION

BLOCK CONFIGURATION OF IMAGE FORMATION APPARATUS ACCORDING TO FIRST EMBODIMENT

WRITING-START-POSITION ALIGNMENT PROCESSING

CONVEYANCE SPEEDS OF INTERMEDIATE TRANSFER BELT AND SHEET

IMAGE FORMATION PROCESSING PROCEDURE ACCORDING TO FIRST EMBODIMENT

IMAGE FORMATION APPARATUS ACCORDING TO SECOND EMBODIMENT

BLOCK CONFIGURATION OF IMAGE FORMATION APPARATUS ACCORDING TO SECOND EMBODIMENT

IMAGE FORMATION PROCESSING PROCEDURE ACCORDING TO SECOND EMBODIMENT

IMAGE FORMATION APPARATUS HAVING INTERMEDIATE TRANSFER BELT SPEED CONTROL

CROSS REFERENCE TO RELATED APPLICATIONS

This application claims priority based on 35 USC 119 from prior Japanese Patent Application No. 2015-181972 filed on Sep. 15, 2015, entitled "IMAGE FORMATION APPARATUS", the entire contents of which are incorporated herein by reference.

BACKGROUND OF THE INVENTION

1. Field of the Invention

This disclosure relates to an image formation apparatus and is suitably applied to, for example, an electrophotographic printer.

2. Description of the Related Art

There has been an image formation apparatus that prints an image, for example, in a way that: a toner image is generated by an exposure device and then is carried by a traveling intermediate transfer belt, while a sheet serving as a medium is conveyed by a conveyer section including rollers and the like; and then the toner image is transferred from the intermediate transfer belt onto the sheet, and finally is fixed to the sheet with application of heat and pressure to the sheet.

When printing the image on the sheet, the image formation apparatus needs to transfer the toner image onto the sheet with the position of the sheet and the position of the toner image carried on the intermediate transfer belt aligned with each other and the traveling speed of the sheet and the traveling speed of the intermediate transfer belt equalized to each other.

To this end, there has been proposed an image formation apparatus including an image sensor that detects the traveling speed of the intermediate transfer belt and the position of the toner image, and a sheet sensor that detects the traveling speed and the position of the sheet. On the basis of the detection results of the sensors, the image formation apparatus adjusts the conveyance speed of the sheet and aligns the position of the sheet with the position of the toner image (see, for example, Japanese Patent Application Publication No. 2010-277038 (FIGS. 6 and 7)).

SUMMARY OF THE INVENTION

However, in most of conventional image formation apparatuses, it is difficult to adjust the traveling speed of the sheet because of constraints of the conveyer section and the like. In this case, it is likely that accuracy is deteriorated in the adjustment of the traveling speeds of the sheet and the intermediate transfer belt, and the alignment of the position of the toner image with the position of the sheet and the quality of the image to be formed is degraded.

An object of an embodiment of the invention is to provide an image formation apparatus that can form a high-quality image on a medium.

An aspect of the invention is an image formation apparatus that includes: an intermediate transfer belt that carries and conveys a developer image formed by an image formation section; a driver that conveys the intermediate transfer belt in a predetermined direction; a transfer device that transfers the developer image carried on the intermediate transfer belt onto a predetermined medium; a first detector that detects the belt conveyance speed, which is the speed of the intermediate transfer belt; a controller that controls the driver; a conveyer section that conveys the medium to the transfer device; and a second detector that detects the medium conveyance speed, which is the speed of the medium being conveyed by the conveyer section. The controller controls the driving of the driver on the basis of the belt conveyance speed and the medium conveyance speed.

According to this aspect of the invention, it is possible to adjust the conveyance speed of the intermediate transfer belt, which carries the developer image, to the conveyance speed of the medium. Therefore, any extension and contraction of the developer image in the conveying direction are not caused in the transfer device. It is possible to transfer the developer image with a high degree of accuracy, while maintaining the quality of the printing.

Therefore, it is possible to provide an image formation apparatus capable of forming a high-quality image on a medium.

DETAILED DESCRIPTION OF EMBODIMENTS

Figure 1:
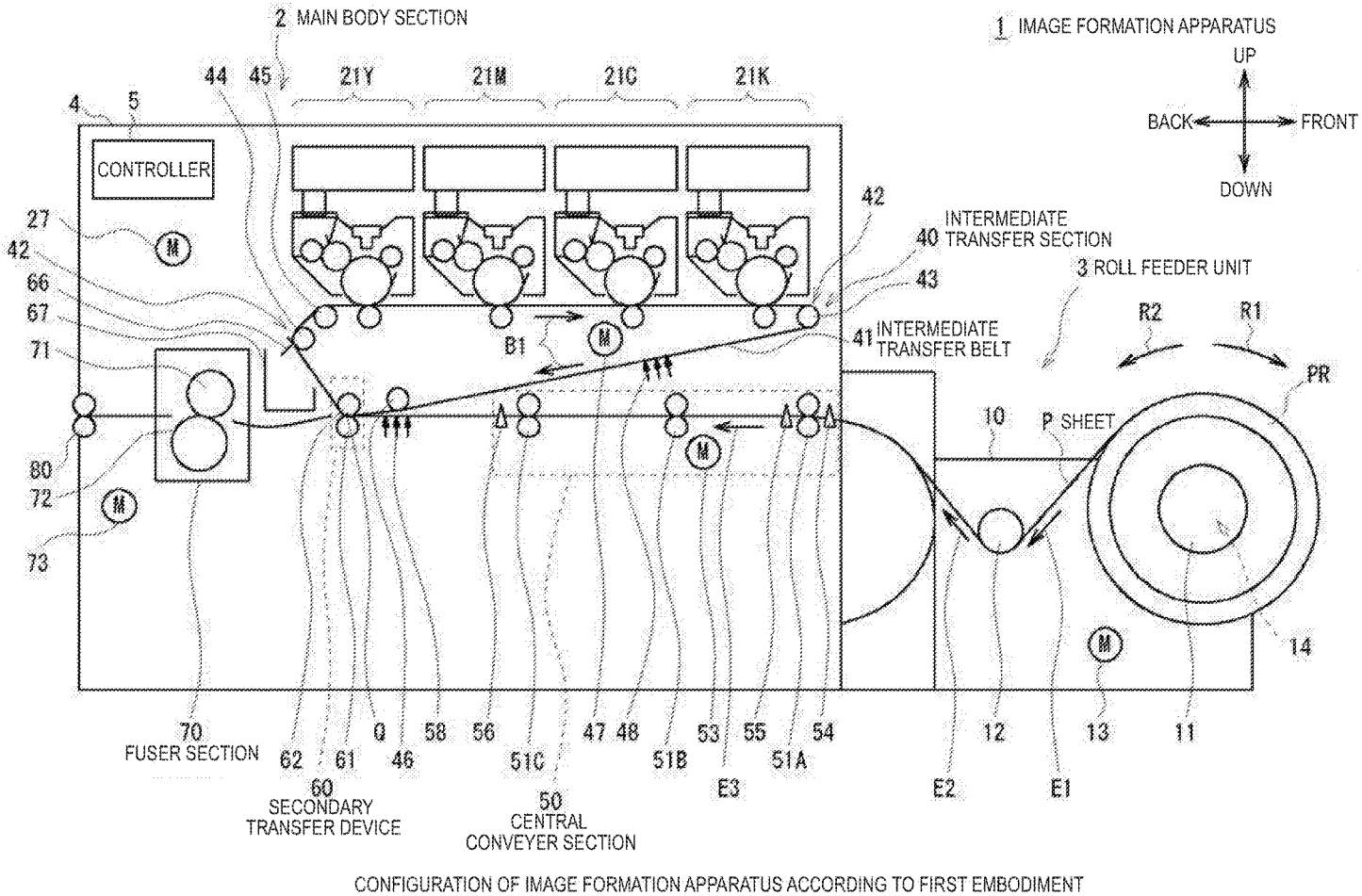
FIG. 1 is a schematic diagram illustrating the configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

1-1. Configuration of an Image Formation Apparatus

As illustrated in FIG. 1, image formation apparatus 1 according to a first embodiment is configured as an electrophotographic printer. Image formation apparatus 1 is configured to print a desired color image on, for example, a long sheet P. Image formation apparatus 1 mainly includes main body section 2 disposed on the back side, and roll feeder unit 3 disposed on the front side. Controller 5 that collectively controls the entire image formation apparatus 1 is provided on the inside of main body section 2.

For convenience of explanation, in the following explanation, the roll feeder unit 3 side is defined as the front side, the main body section 2 side is defined as the back side, the near side of the paper surface in FIG. 1 is defined as the left side, the depth side of the paper surface is defined as the right side, and the upper side and the lower side are further defined.

Sheet P serving as a medium is wound to turn around the circumferential side surface of a core material (not illustrated in the figure) extending along the left-right direction and is formed in a roll shape (this portion is hereinafter referred to as roll section PR). During printing, one end is peeled from the outermost circumference of roll section PR. Roll feeder unit 3 includes housing 10 disposed in the center thereof and is formed in a relatively small rectangular parallelepiped shape. In housing 10, roll section PR of sheet P is rotatably held by roll holder 11 provided on the front upper side of housing 10.

Roll conveyance guide roller 12 is provided on the back lower side of roll holder 11 in housing 10. When one end is peeled from the outermost circumference of roll section PR, sheet P is pulled out in a back downwardly direction along arrow E1, passes the lower side of roll conveyance guide roller 12 to change the traveling direction thereof to the back upper direction and travel in a direction of arrow E2, and is taken into main body section 2.

When sheet P travels to the main body section 2 side, roll section PR rotates in an arrow R2 direction. On the other hand, roll feeder unit 3 applies a driving force of back tension motor 13 to roll holder 11 via torque limiter 14 to thereby apply force to roll section PR in an arrow R1 direction.

In main body section 2, four primary transfer sections 21Y, 21M, 21C, and 21K are disposed to be arrayed along the front-back direction near the top on the inside of housing 20 formed in a rectangular parallelepiped shape. Primary transfer sections 21Y, 21M, 21C, and 21K respectively correspond to the colors of yellow (Y), magenta (M), cyan (C), and black (K).

Figure 2:
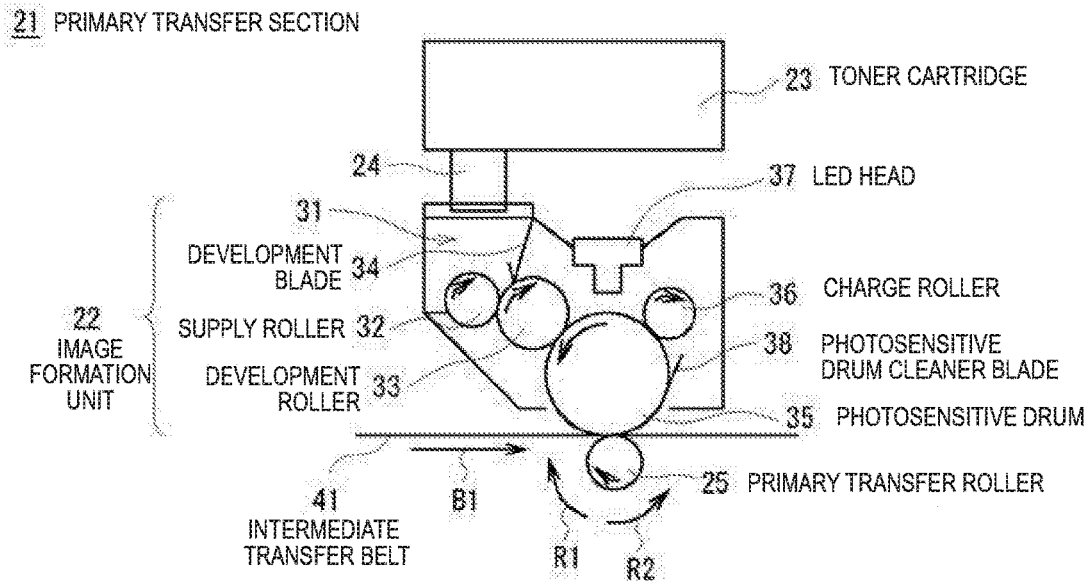
FIG. 2 is a schematic diagram illustrating the configuration of a primary transfer section.

Primary transfer sections 21Y, 21M, 21C, and 21K (hereinafter collectively referred to as primary transfer sections 21 as well) have the same configuration except that only the colors are different. As illustrated in FIG. 2, primary transfer section 21 includes image formation unit 22 disposed in the center and functioning as an image formation section, and also includes toner cartridge 23, toner duct 24, and primary transfer roller 25 that are disposed around image formation unit 22.

Toner cartridge 23 stores toner serving as a developer. Toner cartridge 23 is disposed on the upper side of image formation unit 22 and is attached to image formation unit 22 via toner duct 24. Toner cartridge 23 supplies the toner to toner storage section 31 of image formation unit 22 via toner duct 24.

In image formation unit 22, besides toner storage section 31, the following components are also incorporated therein: supply roller 32, development roller 33, development blade 34, photosensitive drum 35, charge roller 36, LED (Light Emitting Diode) head 37, and photosensitive drum cleaner blade 38. A driving force is supplied to image formation unit 22 from image formation motor 27 (FIG. 1), whereby supply roller 32, development roller 33, and charge roller 36 are rotated in the arrow R1 direction and photosensitive drum 35 is rotated in the arrow R2 direction.

A predetermined bias voltage is applied to supply roller 32. Supply roller 32 causes the toner in toner storage section 31 to adhere to the circumferential side surface of supply roller 32 and rotates to thereby cause the toner to adhere to the circumferential side surface of development roller 33. The predetermined bias voltage is applied to development roller 33 as well. After excess toner is removed from the circumferential side surface of development roller 33 by development blade 34, development roller 33 brings its circumferential side surface into contact with the circumferential side surface of photosensitive drum 35.

On the other hand, in a state where the predetermined bias voltage is applied to charge roller 36, charge roller 36 comes into contact with photosensitive drum 35 to thereby uniformly charge the circumferential side surface of photosensitive drum 35. In LED head 37, LED chips are linearly disposed along the left-right direction. The LED chips emit light at predetermined time intervals in a light emission pattern based on image data supplied from controller 5 (FIG. 1). Consequently, an electrostatic latent image is formed on the circumferential side surface near the upper end of photosensitive drum 35.

Subsequently, photosensitive drum 35 rotates in the arrow R2 direction to thereby bring a part where the electrostatic latent image is formed into contact with development roller 33. Consequently, the toner adheres to the circumferential side surface of photosensitive drum 35 on the basis of the electrostatic latent image. A toner image based on the image data is developed.

Primary transfer roller 25 serving as a primary transfer device is disposed on the lower side of photosensitive drum 35. The vicinity of the upper end on the circumferential side surface of primary transfer roller 25 is in contact with the vicinity of the lower end of photosensitive drum 35. Intermediate transfer belt 41 (explained in detail below) is held between primary transfer roller 25 and photosensitive drum 35. Thus, primary transfer roller 25 is rotated by the movement of intermediate transfer belt 41, which is driven by the rotation of photosensitive drum 35 and transfer-belt drive roller 43. That is, primary transfer roller 25 rotates in the arrow R1 direction with the predetermined bias voltage applied. Therefore, primary transfer roller 25 can transfer a toner image developed on the circumferential side surface of photosensitive drum 35 onto intermediate transfer belt 41. Consequently, intermediate transfer belt 41 carries the toner image. The toner remaining on the circumferential side surface of photosensitive drum 35 is scraped off by photosensitive drum cleaner blade 38.

Intermediate transfer section 40 is disposed on the lower side of primary transfer sections 21 (21Y, 21M, 21C and 21K) on the inside of housing 20 (FIG. 1). Intermediate transfer section includes intermediate transfer belt 41 and intermediate-transfer-belt travel section 42 for causing intermediate transfer belt 41 to travel.

Intermediate transfer belt 41 is made of a material having flexibility and configured as an endless belt. Intermediate-transfer-belt travel section 42 includes rollers such as transfer-belt drive roller 43 on the front side, transfer-belt driven rollers 44 and 45 on the back side, and transfer-belt driven roller 46 on the lower side. Intermediate transfer belt 41 is stretched and suspended to surround the rollers (i.e., transfer-belt drive roller 43 and transfer-belt driven rollers 44, 45, and 46) of intermediate-transfer-belt travel section 42 and backup roller 62 of secondary transfer device 60 explained below.

Transfer-belt drive roller 43 is driven to rotate by belt motor 47 functioning as a drive section via a gear and the like (not illustrated in the figures). The rotation of transfer-belt drive roller 43 drives intermediate transfer belt 41 to travel in the arrow B1 direction. The travel movement of intermediate transfer belt 41 drives the rollers of intermediate-transfer-belt travel section 42 and backup roller 62 respectively to rotate. Note that secondary transfer roller 61, which is pressed against backup roller 62 with transfer intermediate transfer belt 41 therebetween, is also rotated by the travel movement of intermediate transfer belt 41.

Incidentally, belt motor 47 is a DC (Direct Current) brushless motor. The rotating speed of belt motor 47 is controlled according to a cycle of a pulse included in a pulse signal supplied from controller 5. Therefore, in a state where belt motor 47 is subjected to a constant speed control to a predetermined speed, a traveling distance per one pulse is uniquely decided. Controller 5 controls the cycle of the pulse in the pulse signal supplied to belt motor 47 and counts the number of pulses supplied to belt motor 47. Therefore, in the state where belt motor 47 is subjected to the constant speed control, controller 5 can calculate a traveling distance of intermediate transfer belt 41, that is, a conveyance distance of a toner image, by multiplying the counted number of pulses with a predetermined coefficient.

In intermediate transfer section 40, image conveyance speed sensor 48 is provided on the lower side of intermediate transfer belt 41 between transfer-belt drive roller 43 and transfer-belt driven roller 46. In image conveyance speed sensor 48 functioning as a first detector, an image sensor (an image pickup element) is incorporated. Image conveyance speed sensor 48 picks up, with the image sensor, at predetermined time intervals, a toner image transferred onto intermediate transfer belt 41. Subsequently, image conveyance speed sensor 48 applies a predetermined speed detection processing to sequentially obtained images to thereby detect the moving speed of the toner image, that is, the conveyance speed of intermediate transfer belt 41, and supplies the moving speed to controller 5.

Further, on the lower side of intermediate transfer section 40 on the inside of housing 20, central conveyance section 50, secondary transfer section 60, fuser section 70, and discharge roller pair 80 are disposed in this order from the front side toward the back side in a place substantially in the center in the up-down direction in housing 20.

In central conveyer section 50 functioning as a conveyer section, three conveyance roller pairs 51A, 51B, and 51C are disposed to be spaced apart from one another in the front-back direction. Each of conveyance roller pairs 51A, 51B, and 51C (hereinafter collectively referred to as conveyance roller pairs 51) includes a set of two rollers. The two rollers are disposed to sandwich a conveyance path of sheet P from above and below. A driving force is transmitted to at least one of the rollers of conveyance roller pair 51 from conveyance motor 53 via a gear, a belt, and the like (not illustrated in the figures). The roller rotates with the driving force and conveys sheet P along the conveyance path.

Incidentally, conveyance motor 53 is a pulse motor (i.e., a stepping motor). Conveyance motor 53 is closely subjected to a driving control according to a pulse signal supplied from controller 5. Therefore, a traveling distance per one pulse of conveyance motor 53 is uniquely decided irrespective of the rotating speed of conveyance motor 53. As in the case of belt motor 47, controller 5 controls a cycle of a pulse in the pulse signal supplied to conveyance motor 53 and counts the number of pulses supplied to conveyance motor 53. Therefore, controller 5 can calculate a conveyance distance of sheet P by conveyance roller pair 51 by multiplying the counted number of pulses with a predetermined coefficient.

Provided in central conveyer section 50 are three sensors, that is, inlet sensor 54, bite sensor 55, and write-start sensor 56 that detect the presence or absence of sheet P. Inlet sensor 54 is disposed on the front side of conveyance roller pair 51A disposed on the front most side and detects the leading end of sheet P. Bite sensor 55 is disposed on the back side of conveyance roller pair 51A and detects whether sheet P is bitten by conveyance roller pair 51A. Write-start sensor 56 is disposed on the back side of conveyance roller pair 51C located on the back most side and is used for the purpose of aligning the position of the toner image carried on intermediate transfer belt 41 and the position of sheet P. The output signals of the sensors are OFF when sheet P is not detected and are ON when sheet P is detected.

Further on the back side than conveyance roller pair 51C on the back-most side in central conveyer section 50, and slightly further on the front side than secondary transfer section 60, sheet conveyance speed sensor 58 is provided on the lower side of the conveyance path of sheet P. In sheet conveyance speed sensor 58 functioning as a second detector, as in image conveyance speed sensor 48, an image sensor is incorporated. Sheet conveyance speed sensor 58 detects the conveyance speed of sheet P on the basis of an image obtained by picking up an image of the lower surface of sheet P and supplies the conveyance speed to controller 5.

Secondary transfer device 60 functioning as a transfer device includes secondary transfer roller 61 and backup roller 62, both of which are formed in a cylindrical shape with a center axis directed in the left-right direction. Secondary transfer roller 61 is located on the lower side of intermediate transfer belt 41 and sheet P. The predetermined bias voltage is applied to secondary transfer roller 61. Backup roller 62 is located substantially right above secondary transfer roller 61. Intermediate transfer belt 41 carrying the toner image and sheet P are held between backup roller 62 and secondary transfer roller 61. Incidentally, backup roller 62 is made of, for example, a resin material.

In a state where intermediate transfer belt 41 and sheet P are held between secondary transfer roller 61 and backup roller 62, secondary transfer device 60 rotates secondary transfer roller 61 and backup roller 62 in the arrow R1 direction and the arrow R2 direction, respectively, to thereby transfer the toner image from intermediate transfer belt 41 onto sheet P. At this point, intermediate transfer belt 41 is bent along the circumferential side surface of backup roller 62. Intermediate transfer belt 41 approaches sheet P from a position away from sheet P. After coming into contact with sheet P, intermediate transfer belt 41 moves away from sheet P again. For convenience of explanation, a position where intermediate transfer belt 41 and sheet P are in contact with each other and the toner image is transferred is referred to as secondary transfer position Q.

Intermediate-transfer-belt cleaner blade 66 is provided on the back upper side of secondary transfer device 60. Waste toner box 67 is disposed below intermediate-transfer-belt cleaner blade 66. Intermediate-transfer-belt cleaner blade 66 is in contact with intermediate transfer belt 41. Intermediate-transfer-belt cleaner blade 66 scrapes off toner adhering to (i.e., remaining on) intermediate transfer belt 41 without being transferred from intermediate transfer belt 41 onto sheet P in secondary transfer device 60, and stores the toner in waste toner box 67. Consequently, intermediate transfer belt 41 changes to a state where the toner does not adhere to intermediate transfer belt 41, that is, a state where a new toner image can be transferred onto intermediate transfer belt 41 in primary transfer section 21.

In fuser section 70 serving as a fixation device or a fixation unit, heat roller 71 and press roller 72 are disposed to hold sheet P from above and below. Heat roller 71 is formed in a cylindrical shape with a center axis directed in the left-right direction. A heater is provided on the inside of heat roller 71. Press roller 72 is formed in a cylindrical shape, the same as the cylindrical shape of heat roller 71. A heater is provided on the inside of press roller 72. Press roller 72 presses the surface on the upper side of press roller 72 against the surface on the lower side in heat roller 71 with a predetermined pressing force. A driving force is transmitted to heat roller 71 and press roller 72 from fuse-discharge motor 73 via a gear, a belt, and the like (not illustrated in the figures), whereby heat roller 71 and press roller 72 respectively rotate in the arrow R1 direction and the arrow R2 direction. Incidentally, a temperature detector (not illustrated in the figures) that detects temperature is provided in fuser section 70. The temperature detector detects temperatures of heat roller 71 and press roller 72 and notifies controller 5 of the temperatures.

Fuser section 70 heats heat roller 71 and rotates heat roller 71 and press roller 72 respectively in predetermined directions on the basis of the control by controller 5 to thereby apply heat and pressure to sheet P and fix the toner image and passes sheet P to discharge roller pair 80 in the back. Consequently, an image based on the image data is formed on sheet P.

Like conveyance roller pair 51 of central conveyer section 50, discharge roller pair 80 is disposed to hold sheet P from above and below with two rollers. A driving force is transmitted to the rollers of discharge roller pair 80 from fuse-discharge motor 73 via a gear, a belt, and the like (not illustrated in the figures). Consequently, discharge roller pair 80 can discharge sheet P to the back of main body section 2. Incidentally, sheet P discharged to the back from main body section 2 is wound by a sheet winder (not illustrated in the figures) set on the back side of main body section 2.

Figure 3:
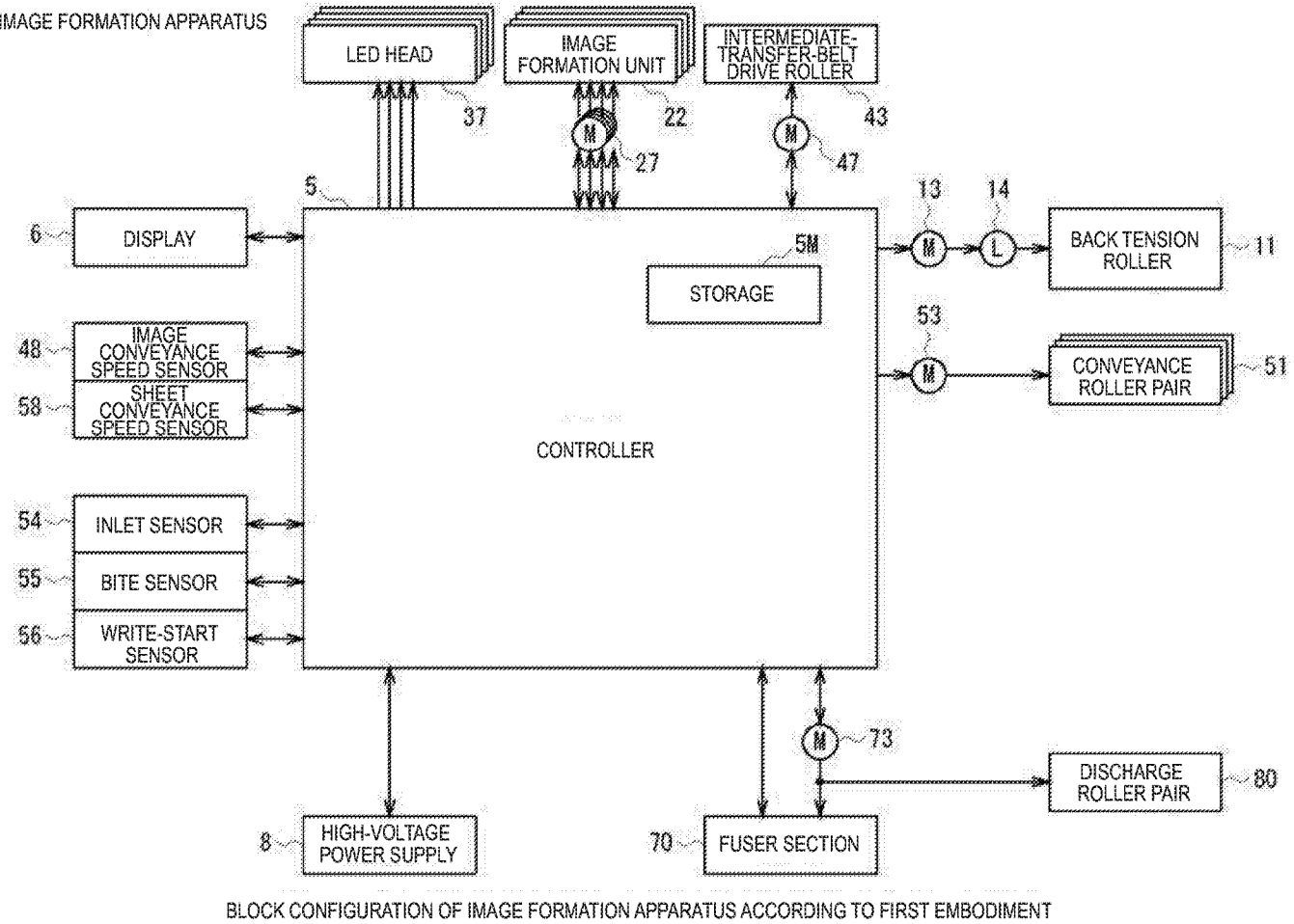
FIG. 3 is a block diagram illustrating the block configuration of the image formation apparatus according to the first embodiment.

As illustrated in FIG. 3, controller 5 includes a not-illustrated CPU (Central Processing Unit) in the center thereof. Controller 5 reads out predetermined computer programs from a ROM (Read Only Memory), a flash memory, and the like (not illustrated in the figures) and executes the computer programs to thereby perform various kinds of processing concerning printing. Controller 5 includes storage 5M including a RAM (Random Access Memory), a hard disk drive, and a flash memory and causes storage 5M to store various kinds of information.

Display 6, high-voltage power supply 8, and the like are also connected to controller 5. Display 6 includes a liquid crystal panel and displays various kinds of information that should be notified to a user. High-voltage power supply 8 applies the predetermined bias voltage to supply roller 32, development roller 33, and charge roller 36 of image formation unit 22 (FIG. 2), primary transfer roller 25, and secondary transfer roller 61 and backup roller 62 of secondary transfer device 60 (FIG. 1), respectively, at predetermined timings.

In this way, image formation apparatus 1 transfers, with primary transfer section 21, the toner image onto intermediate transfer belt 41 which is caused to travel by intermediate-transfer-belt travel section 42, conveys sheet P with central conveyer section 50, transfers the toner image from intermediate transfer belt 41 onto sheet P with secondary transfer device 60, and fixes the toner image with fuser section 70 to perform printing on sheet P.

1-2. Image Formation Processing

In image formation apparatus 1 (FIG. 1), when print processing is started for the first time, a distal end portion of sheet P is pulled out by manual work of the user from roll section PR of sheet P held by roll holder 11, caused to pass on the lower side of roll conveyance guide roller 12, and then inserted into main body section 2 from the front side of central conveyer section 50.

At this point, when inlet sensor 54 detects the leading end of sheet P, controller 5 drives conveyance motor 53 to rotate conveyance roller pair 51 and to thereby convey sheet P backwards. At a stage when bite sensor 55 detects the leading end of sheet P, that is, at a stage when the vicinity of the leading end of sheet P is held by conveyance roller pair 51A, controller 5 stops the conveyance.

Roll feeder unit 3 causes a certain degree of tension to sheet P by applying a driving force of back tension motor 13 to roll holder 11 via torque limiter 14. Consequently, roll feeder unit 3 can generate an appropriate tension and prevent the occurrence of creases and the like in sheet P without hindering the advancement of sheet P to main body section 2.

Controller 5 (FIGS. 1 and 3) is connected to a host apparatus (not illustrated in the figures), such as a personal computer, by radio or wire via a not-illustrated communication processor. When image data representing a printing target image is given and a printing of the image data is instructed from the host apparatus, controller 5 starts the print processing for forming the image on the surface of sheet P. Incidentally, controller 5 sets, as a start condition for the printing operation, the detection of sheet P by bite sensor 55.

First, controller 5 heats heat roller 71 and press roller 72 of fuser section 70 and controls the heating according to a temperature received from a temperature detector (not illustrated in the figures) to thereby adjust the temperature to a predetermined temperature. Controller 5 supplies a driving force from belt motor 47 of intermediate transfer section 40 to intermediate-transfer-belt travel section 42 to thereby cause intermediate transfer belt 41 to move or travel.

Subsequently, after applying a predetermined image processing and the like to the image data acquired from the host apparatus, controller 5 decomposes the image data into image data of the respective colors of yellow (Y), magenta (M), cyan (C), and black (K) and supplies the image data to LED heads 37 in image formation units 22 (FIG. 2) of the respective colors, respectively. According to the supply of the respective image data, image formation units 22 rotate supply rollers 32, photosensitive drums 35, and the like with a driving force from image formation motor 27 (FIG. 1), cause LED heads 37 to emit lights in a light emission pattern based on the supplied image data, to form toner images on photosensitive drums 35, and to sequentially transfer toner images onto intermediate transfer belt 41. Consequently, toners for the four colors are sequentially superimposed and the toner images are carried on intermediate transfer belt 41.

After a predetermined time elapses from a point in time when the light emission of LED head 37 is started in image formation unit 22, controller 5 supplies a driving force from conveyance motor 53 to conveyance roller pair 51. This starts the conveyance of sheet P, and advances sheet P to secondary transfer device 60. Controller 5 then performs a type of processing called write-start-position alignment processing.

Specifically, first, when detecting the leading end of sheet P with write-start sensor 56, controller 5 recognizes a positional relation between sheet P and the toner image on intermediate transfer belt 41 and detects a difference amount of position between the positions of sheet P and the toner image using a traveling distance and the like of intermediate transfer belt 41 obtained from a driving amount of belt motor 47. The difference amount between the positions represents a distance of preceding sheet P from the toner image. Subsequently, controller 5 calculates a time with an arithmetic processing explained below and then controls conveyance motor 53 to temporarily reduce the conveyance speed of sheet P and thereafter increase the conveyance speed again to thereby align the positions of sheet P and the toner image in secondary transfer device 60.

After transferring the toner image from intermediate transfer belt 41 onto sheet P in secondary transfer position Q with secondary transfer device 60, controller 5 heats and pressurizes sheet P in fuser section 70 to thereby fix the toner image. Sheet P is discharged to the back of main body section 2 by discharge roller pair 80.

1-3. Write-Start-Position Alignment Processing

The write-start-position alignment processing performed by controller 5 in the printing operation (i.e., the image formation processing) explained above is further explained with reference to FIG. 4(A), which is an extraction of a part of FIG. 1. First, controller 5 conveys sheet P to precede the toner image to a certain degree. At this point, a preceding distance of sheet P from the toner image is also referred to as an adjustment distance. Incidentally, it is likely that, when the adjustment distance is too short, an adjustment range of positions is narrowed and, when the adjustment distance is too long, the adjustment distance leads to a decrease in adjustment accuracy and the like. Therefore, the adjustment distance is desirably approximately 15 mm to 35 mm.

Figure 4:
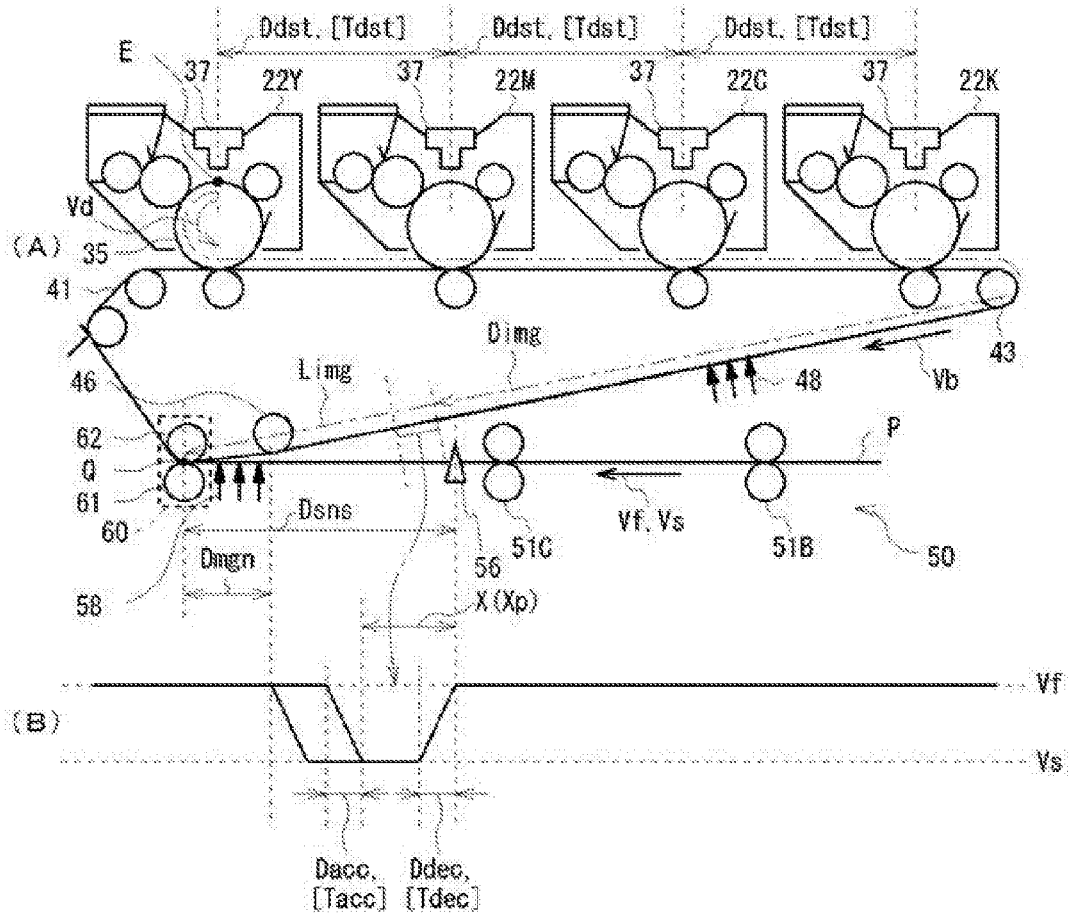
FIG. 4 illustrates schematic diagrams (A) and (B) for explaining the writing-start-position alignment processing.

Controller 5 rotates conveyance motor 53 of central conveyer section 50 at a normal rotating speed to thereby convey sheet P at a sheet conveyance speed Vf, which is the normal conveyance speed, with conveyance roller pairs 51. Thereafter, at a point in time when write-start sensor 56 detects the leading end of sheet P (hereinafter referred to as write-start point in time), controller 5 controls the rotating speed of conveyance motor 53. As illustrated in FIG. 4(B), controller 5 reduces the conveyance speed of sheet P to a sheet adjustment speed Vs that is lower than the sheet conveyance speed Vf. Incidentally, FIG. 4(B) is a waveform representing the conveyance speed of sheet P. The abscissa represents the position of the leading end of sheet P to correspond to FIG. 4(A). The ordinate represents the magnitude of the conveyance speed.

Controller 5 counts the number of pulses in a pulse signal supplied to conveyance motor 53. The number of pulses is equivalent to the conveyance distance of sheet P. The number of pulses can be converted into the conveyance distance [mm] of sheet P by multiplying the number of pulses with a ratio explained below. Further, controller 5 calculates, according to a calculation method explained below, re-acceleration pulse value Xp, which is the number of pulses to a point in time when the conveyance speed of sheet P is started to be increased again, based on the write-start point in time.

Then, at a point in time when the number of pulses in the pulse signal supplied to conveyance motor 53 reaches re-acceleration pulse value Xp after the write-start point in time, controller 5 increases the conveyance speed of sheet P and resets the conveyance speed from sheet adjustment speed Vs to sheet conveyance speed Vf. Consequently, controller 5 can align the position of the toner image on intermediate transfer belt 41 and the position of sheet P with each other.

Re-acceleration pulse value Xp is explained. For convenience of explanation, various values are defined in advance. In primary transfer section 21Y located on the most upstream side, a place where photosensitive drum 35 is exposed to light by LED head 37 is referred to as most upstream exposure position E.

Image conveyance distance Limg is a conveyance distance [mm] of the toner image from most upstream exposure position E to secondary transfer position Q. Image conveyance position Dimg is a conveyance distance [mm] of the toner image from most upstream exposure position E at the write-start point in time. Incidentally, image conveyance position Dimg can be obtained by multiplying the number of pulses in the pulse signal supplied to belt motor 47 (FIG. 1) from most upstream exposure position E until write-start sensor 56 detects the leading end of sheet P (e.g., detects when the write-start point in time comes) with a coefficient representing a belt traveling distance per one pulse [mm/pulse].

Distance Dsns is a distance [mm] from write-start sensor 56 to secondary transfer position Q. Distance Ddec is a distance [mm] in which sheet P is conveyed from a deceleration start until deceleration is completed, by conveyance motor 53. Distance Dacc is a distance [mm] in which sheet P is conveyed from an acceleration start until acceleration is completed, by conveyance motor 53. Distance Dmgn is the distance between the leading end of sheet P and secondary transfer position Q at a point in time when the acceleration is completed.

Time Tdec is a time [s] in which conveyance motor 53 is decelerated. Time Tacc is a time [s] in which conveyance motor 53 is accelerated. Distance pulse ratio Pf is a conveyance distance [mm/pulse] of sheet P by conveyance roller pair 51 per one pulse in a pulse signal supplied to conveyance motor 53 (FIG. 1).

Sheet conveyance speed Vf is the conveyance speed [mm/s] of sheet P by conveyance roller pair 51 at a normal time. Sheet adjustment speed Vs is the conveyance speed [mm/s] of sheet P by conveyance roller pair 51 at a deceleration time. Belt conveyance speed Vb is the conveyance speed [mm/s] of intermediate transfer belt 41. Re-acceleration distance X is a distance [mm] from the position of write-start sensor 56 to the position of sheet P at a point in time when the conveyance speed is started to be increased again. Re-acceleration distance X is a value obtained by converting re-acceleration pulse value Xp, which is the number of pulses, into a distance.

Distance Ddst is a distance [mm] between places where photosensitive drums 35 are respectively exposed to light by LED heads 37 in image formation units 22 adjacent to each other. LED head light emission interval Tdst is a time [s] from light emission of LED head 37 on the upstream side until light emission of LED head 37 on the downstream side when the same image data is formed in image formation units 22 adjacent to each other. Photosensitive drum speed Vd is the speed of the circumferential side surface (the surface) in photosensitive drum 35. Transfer accuracy of the toner image onto intermediate transfer belt 41 is increased by setting photosensitive drum speed Vd slightly lower than belt conveyance speed Vb.

When the values defined as explained above are used, time T1 from the write-start point in time until the toner image reaches secondary transfer position Q can be represented by the following Expression (1):

$$T1 = \frac{Limg - Dimg}{Vb} \tag{1}$$

Time T2 from the write-start point in time until sheet P reaches secondary transfer position Q can be represented by the following Expression (2):

$$T2 = Tdec + \frac{X - Ddec}{Vs} + Tacc + \frac{Dsns - X - Dacc}{Vf} \tag{2}$$

Since time T1 is equal to time T2, when the expressions are arranged by putting the expressions as (1)=(2), re-acceleration distance X can be represented by the following Expression (3) by using parameters C1 and C2. Parameters C1 and C2 are respectively represented as Expression (4) and Expression (5):

$$X = C1(Limg - Dimg) + C2 \tag{3}$$

$$C1 = \frac{Vf \cdot Vs}{Vb(Vf - Vs)} \tag{4}$$

$$C2 = \frac{Vf \cdot Vs(Tacc + Tdec) + Vs(Dsns - Dacc) - Vf \cdot Ddec}{Vs - Vf} \tag{5}$$

A relation of the following Expression (6) holds among re-acceleration distance X, re-acceleration pulse value Xp, and distance pulse ratio Pf.

$$Xp = \frac{X}{Pf} \tag{6}$$

Controller 5 can obtain re-acceleration pulse value Xp by substituting re-acceleration distance X obtained from Expression (3), Expression (4), and Expression (5) in Expression (6).

Incidentally, in Expressions (1) to (5), belt conveyance speed Vb and sheet conveyance speed Vf are treated as different values. This is because the thickness and the bend of intermediate transfer belt 41 are taken into account.

Figure 5:
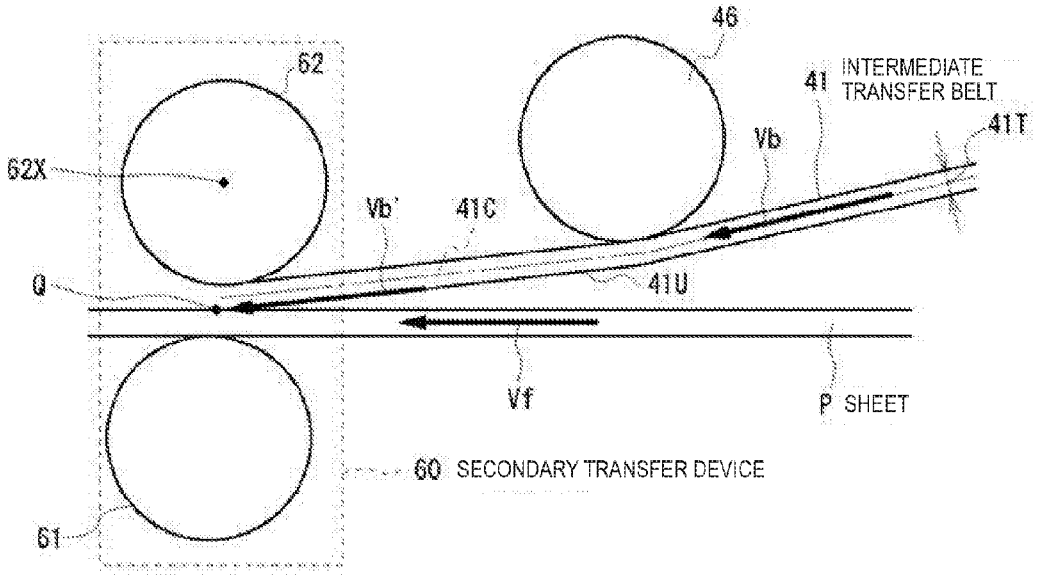
FIG. 5 is a schematic diagram illustrating the conveyance speeds of an intermediate transfer belt and a sheet.

In FIG. 5 in which a part of FIG. 4(A) is enlarged, intermediate transfer belt 41 has a sufficient thickness 41T. Therefore, imaginary center line 41C representing the center in the thickness direction is assumed. Both of lower surface 41U and center line 41C of intermediate transfer belt 41 advance at belt conveyance speed Vb in a portion where intermediate transfer belt 41 linearly advances, for example, a portion where intermediate transfer belt 41 is stretched and suspended between transfer-belt drive roller 43 (FIG. 4(A)) and transfer-belt driven roller 46.

On the other hand, intermediate transfer belt 41 advances to bend along the outer circumferential surface of backup roller 62 in the vicinity of secondary transfer position Q. That is, in intermediate transfer belt 41, distances from center point 62X, which is a rotation center of backup roller 62, to center line 41C and lower surface 41U are different from each other.

Therefore, when intermediate transfer belt 41 advances while bending along the outer circumferential surface of backup roller 62, center line 41C is advanced generally at belt conveyance speed Vb. However, lower surface 41U is advanced at belt surface conveyance speed Vb', higher than belt conveyance speed Vb. In intermediate transfer belt 41, lower surface 41U carries the toner image and is in contact with sheet P.

Therefore, controller 5 can transfer the toner image onto sheet P without deteriorating the image quality by matching belt surface conveyance speed Vb', which is the speed of lower surface 41U, with sheet conveyance speed Vf. Since the radius of backup roller 62 is a fixed value, a ratio of belt conveyance speed Vb to belt surface conveyance speed Vb' is also a fixed value smaller than 1. In other words, in image formation apparatus 1, when the ratio of the speed (Vb/Vf) reaches a predetermined target value (hereinafter referred to as target speed ratio Abf), a relation of "belt surface conveyance speed Vb'=sheet conveyance speed Vf" is established.

1-4. Correction of Conveyance Speed During a Printing Operation

Incidentally, in image formation apparatus 1, even if belt conveyance speed Vb and sheet conveyance speed Vf are set taking into account the bend of intermediate transfer belt 41 along backup roller 62 as explained above, a deviation sometimes occurs between belt surface conveyance speed Vb' and sheet conveyance speed Vf because of the thickness and the type of sheet P, manufacturing errors of the rollers and the belts, and the like. In such a case, in image formation apparatus 1, the toner image transferred onto sheet P in secondary transfer device 60 is extended or reduced more than the original toner image along the conveyance direction of sheet P. As a result, image quality is deteriorated.

Therefore, in image formation apparatus 1, conveyance speed correction processing for correcting belt conveyance speed Vb according to sheet conveyance speed Vf is performed during a printing operation according to the control by controller 5. For convenience in the following explanation, belt conveyance speed Vb that should be corrected, that is, a target value of belt conveyance speed Vb, is represented as belt conveyance correction value Vbt. A proper value in design in belt conveyance speed Vb is represented as belt conveyance reference speed Vbb.

Figure 6:
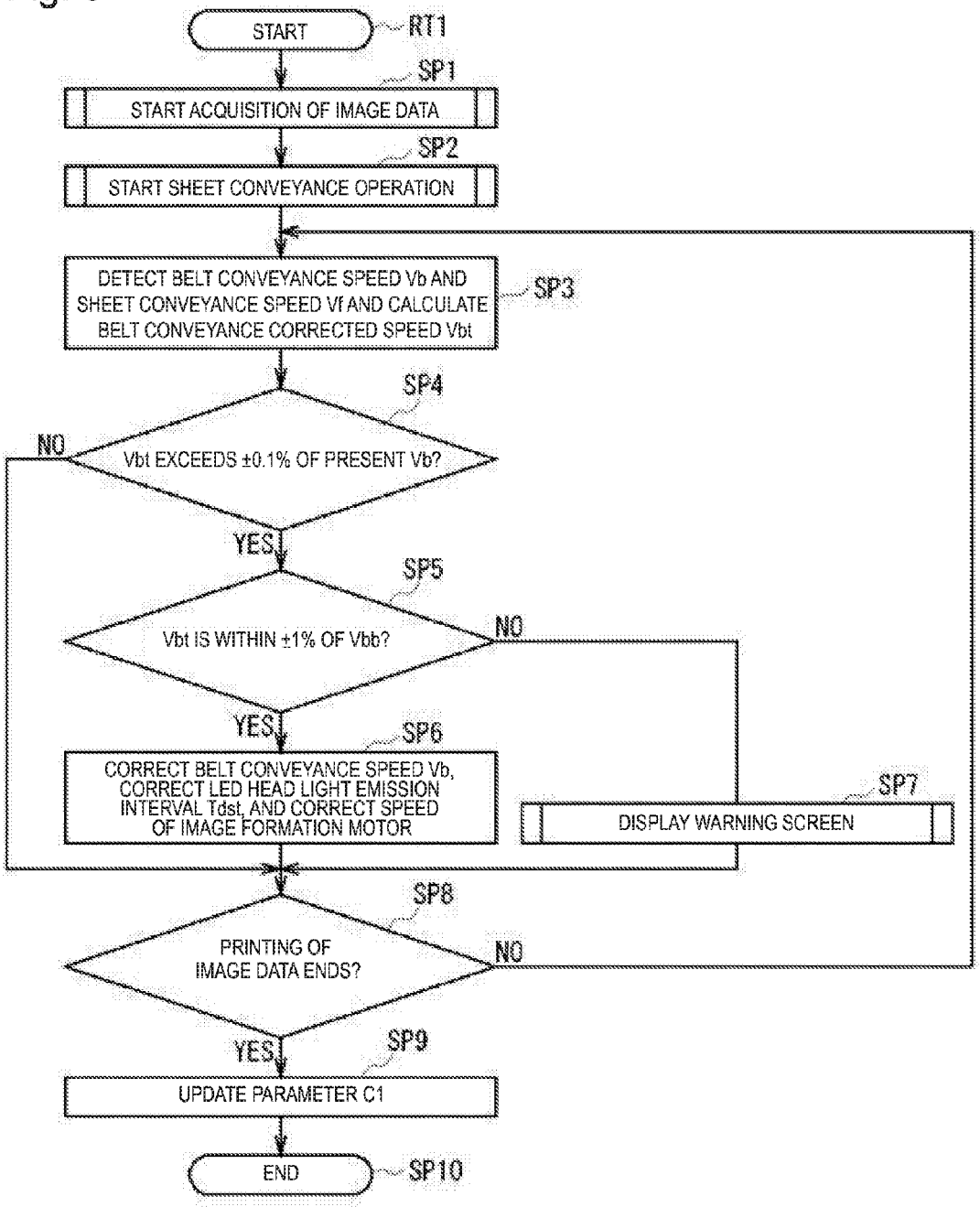
FIG. 6 is a flowchart for explaining an image formation processing procedure according to the first embodiment.

When receiving an instruction for printing from the host apparatus (not illustrated in the figures), controller 5 reads out an image formation program from storage 5M and executes the image formation program to thereby start the image formation processing illustrated in FIG. 6 and shift to first step SP1. In step SP1, controller 5 starts an acquisition processing for image data from the host apparatus, sequentially supplies acquired image data to LED heads 37 of the respective colors, and shifts to the next step SP2.

In step SP2, controller 5 starts a conveyance operation of sheet P to thereby perform the write-start-position alignment processing and then starts a transfer processing of the toner image from intermediate transfer belt 41 onto sheet P by secondary transfer device 60 and shifts to the next step SP3. In step SP3, controller 5 detects belt conveyance speed Vb and sheet conveyance speed Vf respectively with image conveyance speed sensor 48 (FIG. 1) and sheet conveyance speed sensor 58, calculates belt conveyance corrected speed Vbt according to the following Expression (7), and shifts to the next step SP4.

$$Vbt=Abf\times Vf \quad (7)$$

In step SP4, controller 5 determines whether belt conveyance corrected speed Vbt exceeds a range of ±0.1% from the present belt conveyance speed Vb. When an affirmative result is obtained, this indicates that a difference between belt conveyance corrected speed Vbt and the present belt conveyance speed Vb is sufficiently large and exceeds a range in which the difference can be regarded as an error and it is necessary to correct belt conveyance speed Vb. At this point, controller 5 shifts to the next step SP5.

In step SP5, controller 5 determines whether belt conveyance corrected speed Vbt is within a range of ±1% of belt conveyance reference speed Vbb. When an affirmative result is obtained, this indicates that, even if the conveyance speed of intermediate transfer belt 41 is corrected to belt conveyance corrected speed Vbt, since a difference between belt conveyance corrected speed Vbt and belt conveyance reference speed Vbb, which is the reference value in design, is relatively small, it is estimated that the likelihood of an occurrence of deficiencies in the components is extremely low. At this point, controller 5 shifts to the next step SP6.

In step SP6, first, controller 5 controls the rotating speed of belt motor 47 such that belt conveyance speed Vb is corrected to belt conveyance corrected speed Vbt. Subsequently, controller 5 calculates LED head light emission interval Tdst according to the following Expression (8) using belt conveyance speed Vb after the correction (i.e., using belt conveyance corrected value Vbt) and corrects LED head light emission interval Tdst to an obtained value.

$$Tdst = \frac{Ddst}{Vb} \quad (8)$$

Further, controller 5 controls the rotating speed of image formation motor 27 such that photosensitive drum speed Vd, which is the speed of the circumferential side surface (the surface) of photosensitive drum 35, is matched with belt conveyance speed Vb after the correction (i.e., belt conveyance corrected speed Vbt) and shifts to the next step SP8. Incidentally, at this point, in image formation unit 22 (FIG. 2), the rotating speed is also corrected in the other rollers that receive the supply of the driving force from image formation motor 27.

On the other hand, when a negative result is obtained in step SP5, this indicates that, since a difference between belt conveyance corrected speed Vbt and belt conveyance reference speed Vbb, which is the reference value in design, is relatively large, it is estimated that the likelihood of an occurrence of deficiencies in the components is high and indicates that belt conveyance speed Vb should not be corrected to belt conveyance corrected speed Vbt. At this point, controller 5 shifts to the next step SP7.

In step SP7, controller 5 causes display 6 (FIG. 3) to display a predetermined warning screen to thereby notify the user that it is likely that some failure occurs in central conveyer section 50 or the like and shifts to the next step SP8 without correcting belt conveyance speed Vb.

When a negative result is obtained in step SP4, this indicates that, since a difference between belt conveyance corrected speed Vbt and present belt conveyance speed Vb is relatively small and is in a range in which the difference can be regarded as an error, it is unnecessary to correct belt conveyance speed Vb. At this point, controller 5 shifts to the next step SP8 without correcting belt conveyance speed Vb.

In step SP8, controller 5 determines whether all of the toner images based on the image data acquired from the host apparatus are finished being transferred onto sheet P, that is, the print processing based on the image data is ended. When a negative result is obtained, controller 5 returns to step SP3 to thereby repeat the series of processing while the remaining image data is printed.

On the other hand, when an affirmative result is obtained in step SP8, this indicates that advance preparation should be performed for the write-start-position alignment processing performed during a start of the print processing. At this point, controller 5 shifts to the next step SP9. After updating parameter C1 according to Expression (4) described above using the latest belt conveyance speed Vb at an end time of the print processing, controller 5 shifts to the next step SP10 and ends image formation processing procedure RT1.

1-5. Operations and Effects

In the above configuration, after starting the print processing of the image data, controller 5 of image formation apparatus 1 according to the first embodiment acquires sheet conveyance speed Vf and calculates belt conveyance corrected speed Vbt using target speed ratio Abf. Further, controller 5 controls the rotating speed of belt motor 47 such that belt conveyance speed Vb is corrected to belt conveyance corrected speed Vbt.

Therefore, during the execution of the print processing, image formation apparatus 1 can match belt surface conveyance speed Vb', which is the conveyance speed of lower surface 41U (FIG. 5) in intermediate transfer belt 41, with sheet conveyance speed Vf in the vicinity of secondary transfer device 60. Consequently, image formation apparatus 1 can transfer with high accuracy, in secondary transfer device 60, the toner image from lower surface 41U of intermediate transfer belt 41 onto sheet P, the speeds of which substantially coincide with each other, without extending or compressing the toner image in the conveying direction.

From another viewpoint, even when the thickness or the type of sheet P changes or a manufacturing error of the rollers, the belts, and the like occurs, image formation apparatus 1 can correct belt conveyance speed Vb to absorb the change or the manufacturing error. Therefore, when the toner image is transferred in secondary transfer device 60, extension and contraction of an image do not occur and it is possible to maintain high image quality.

Incidentally, in image formation apparatus 1, as a method of aligning and adjusting the positions and the speeds of the image data on intermediate transfer belt 41 and sheet P, it is also conceivable to adjust the conveyance speed of sheet P.

However, as explained above, image formation apparatus 1 urges, with back tension motor 13 (FIG. 1), the back tension in the arrow R1 direction, which is the opposite direction of the rotating direction in pulling out sheet P, against roll section PR of sheet P. Consequently, image formation apparatus 1 can apply an appropriate tension to sheet P being conveyed. As a result, the occurrence of creases, damage to sheet P, and the like are prevented.

Therefore, if the conveyance speed of sheet P is adjusted, from the viewpoint of preventing the occurrence of creases and the like, image formation apparatus 1 needs to simultaneously and appropriately finely control the rotating speeds and back tensions in a large number of conveyance roller pairs and roll sections PR. However, such fine control in image formation apparatus 1 is extremely difficult. Therefore, in image formation apparatus 1, when the fine control cannot be appropriately performed, it is likely that, for example, excessively large tension is applied to sheet P to damage sheet P and creases occur in sheet P.

In view of this point, image formation apparatus 1 can match belt surface conveyance speed Vb' and sheet conveyance speed Vf while stably conveying sheet P, the handling of which is difficult because of its large length, and thus prevent the occurrence of problems by correcting belt conveyance speed Vb, which is the conveyance speed of intermediate transfer belt 41.

Image formation apparatus 1 corrects photosensitive drum speed Vd and LED head light emission interval Tdst of photosensitive drum 35 in addition to belt conveyance speed Vb of intermediate transfer belt 41. Therefore, even at a stage when the toner image is primarily transferred from photosensitive drum 35 to intermediate transfer belt 41 in primary transfer section 21, image formation apparatus 1 can maintain a high image quality without causing extension and compression of an image and without causing color drift and the like.

Further, if belt conveyance corrected speed Vbt calculated on the basis of sheet conveyance speed Vf is within a range of ±0.1% from belt conveyance speed Vb at that point in time, image formation apparatus 1 regards a difference between belt conveyance corrected speed Vbt and belt conveyance speed Vb as being within a range of error and does not correct belt conveyance speed Vb. Consequently, image formation apparatus 1 does not degrade image quality to the contrary by correcting belt conveyance speed Vb at an excessive frequency.

Moreover, if belt conveyance corrected speed Vbt calculated on the basis of sheet conveyance speed Vf exceeds a range of ±1% of belt conveyance reference speed Vbb, image formation apparatus 1 regards that some failure occurs in, for example, central conveyer section 50, which conveys sheet P at sheet conveyance speed Vf, and displays a warning screen without correcting belt conveyance speed Vb. That is, image formation apparatus 1 can detect, on the basis of belt conveyance corrected speed Vbt calculated to correct belt conveyance speed Vb, the occurrence of some failure in central conveyer section 50 and the like originally unrelated to the conveyance by intermediate transfer belt 41 and give notice of the occurrence.

At a point in time when the printing of the image data ends and it is unnecessary to correct belt conveyance speed Vb, image formation apparatus 1 updates parameter C1 using a latest value of belt conveyance speed Vb according to Expression (4). In the write-start-position alignment processing performed when starting the printing of the image data next, image formation apparatus 1 can accurately align the leading end of sheet P with the position of the toner image in intermediate transfer belt 41 according to the most recent states in intermediate transfer section 40 and central conveyer section 50 by calculating and using re-acceleration pulse value Xp using the latest parameter C1.

Incidentally, if sheet conveyance speed sensor 58 is disposed between conveyance roller pairs 51B and 51C, for example, when slack occurs in sheet P between conveyance roller pairs 51B and 51C, it is likely that image formation apparatus 1 cannot correctly detect the speed of sheet P immediately before secondary transfer device 60. In this regard, in actual image formation apparatus 1, sheet conveyance speed sensor 58 is disposed further on the back side than conveyance roller pair 51C on the back most side in central conveyer section 50 and slightly further on the front side than secondary transfer device 60. Therefore, image formation apparatus 1 can accurately detect the conveyance speed in sheet P immediately before sheet P reaches secondary transfer device 60.

In image formation apparatus 1, sheet conveyance speed sensor 58, on the upper surface of which the image pickup element is disposed, is set on the lower side of sheet P (FIG. 1). Consequently, in image formation apparatus 1, even if toner particles drop from the toner image adhering to the outer circumferential surface side of intermediate transfer belt 41 because of, for example, the movement or traveling of intermediate transfer belt 41, since sheet P covers the upper side of sheet conveyance speed sensor 58, that is, the image pickup element side, it is possible to prevent any deterioration in picked-up image quality, that is, a decrease in the detection accuracy of sheet conveyance speed Vf due to a deposit of the toner particles.

According to the configuration explained above, after starting the print processing of the image data, controller 5 of image formation apparatus 1 acquires sheet conveyance speed Vf and calculates belt conveyance corrected speed Vbt using target speed ratio Abf. Thereafter, controller 5 controls the rotating speed of belt motor 47 and corrects belt conveyance speed Vb to belt conveyance corrected speed Vbt. Consequently, during the execution of the print processing, image formation apparatus 1 does not need to change the sheet conveyance speed Vf of sheet P, which is the long paper, and can match the belt surface conveyance speed Vb' with sheet conveyance speed Vf in the vicinity of secondary transfer device 60. As a result, image formation apparatus 1 can transfer with high accuracy the toner image from intermediate transfer belt 41 onto sheet P without extending or compressing the toner image in the conveying direction and realize a high-quality printing.

2. Second Embodiment

Figure 7:
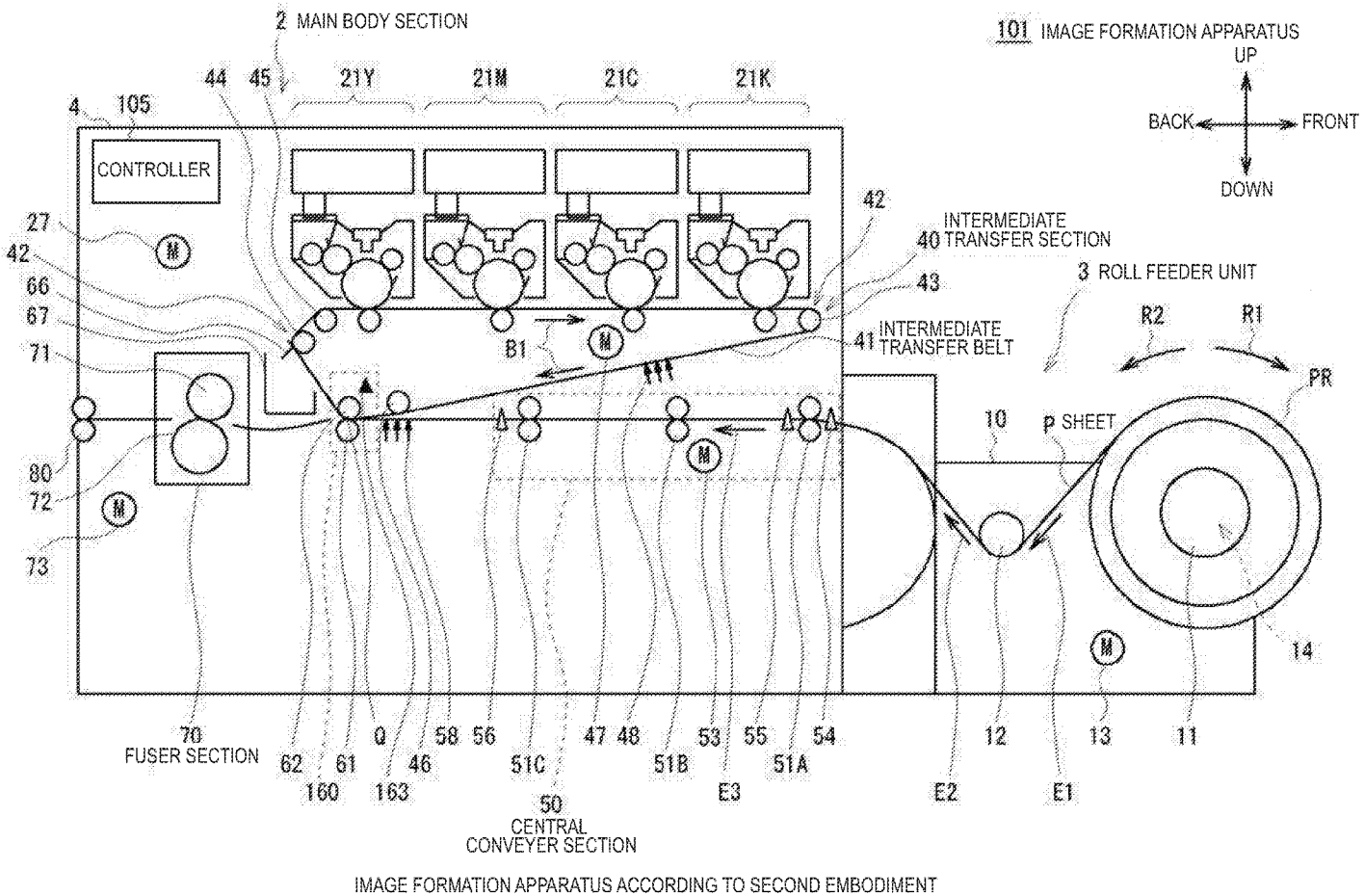
FIG. 7 is a schematic diagram illustrating the configuration of an image formation apparatus according to a second embodiment.
Figure 8:
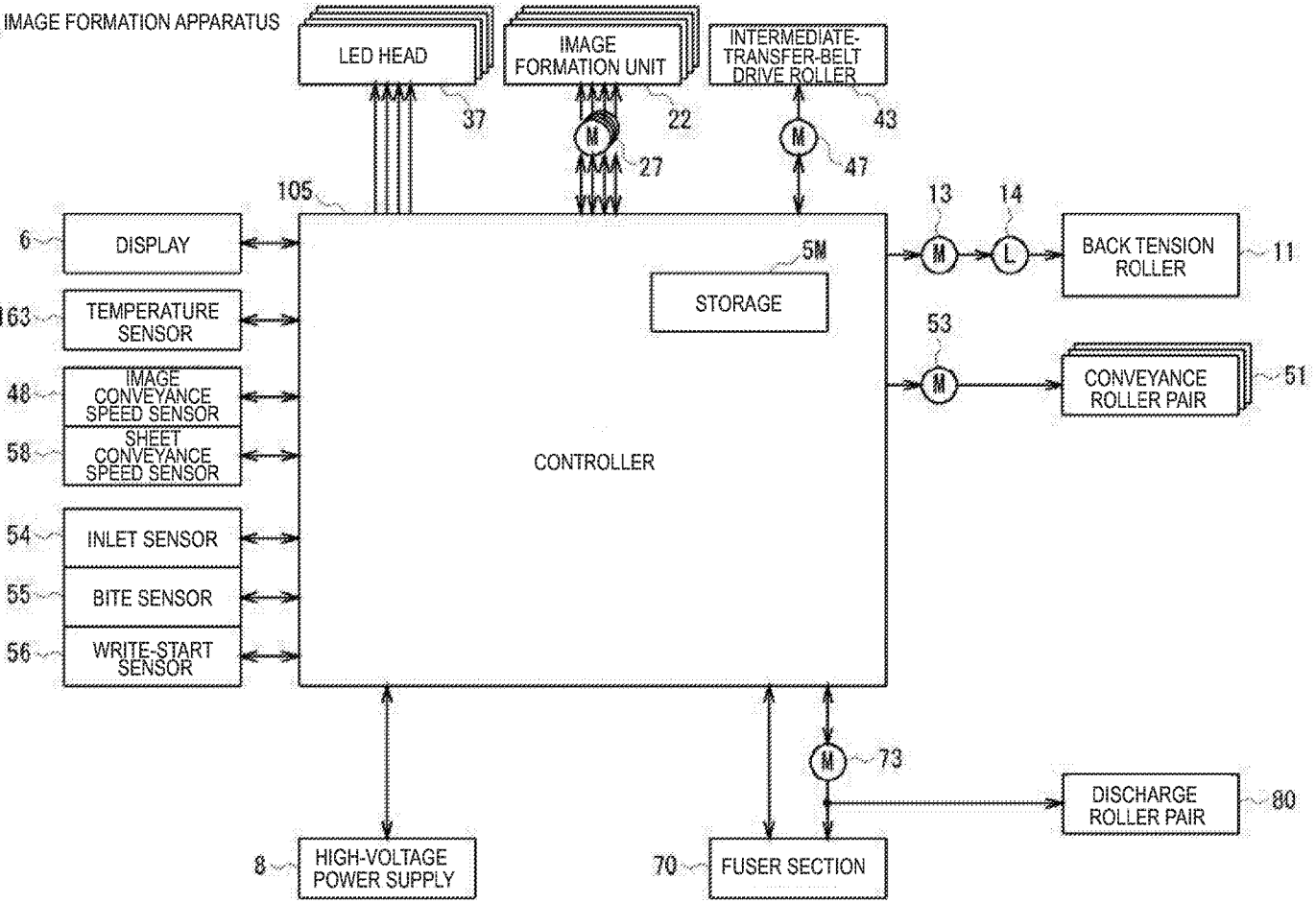
FIG. 8 is a block diagram illustrating the block configuration of the image formation apparatus according to the second embodiment.

As illustrated in FIGS. 7 and 8 respectively corresponding to FIGS. 1 and 3, image formation apparatus 101 according to a second embodiment is the same as image formation apparatus 1 according to the first embodiment except that image formation apparatus 101 includes controller 105 and secondary transfer device 160 instead of controller 5 and secondary transfer device 60.

Like controller 5, controller 105 includes a not-illustrated CPU in the center thereof. Controller 105 reads out predetermined computer programs from a not-illustrated ROM and the like and executes the predetermined computer programs to perform various kinds of processing concerning printing. Controller 105 includes storage 105M formed of a RAM and the like and causes storage 105M to store various kinds of information.

Secondary transfer device 160 is different from secondary transfer device 60 (FIGS. 1 and 3, etc.) according to the first embodiment in that temperature sensor 163 is added. However, secondary transfer device 160 has the same configuration as secondary transfer device 60 concerning secondary transfer roller 61 and backup roller 62. Temperature sensor 163 is disposed in the vicinity of backup roller 62. Temperature sensor 163 detects the ambient temperature, that is, generally the temperature of backup roller 62, and notifies controller 105 of the temperature.

Incidentally, backup roller 62 is made of the resin material as explained above and expands or contracts according to a change in temperature. According to the expansion or contraction of backup roller 62, in image formation apparatus 101, the target speed ratio Abf, which is the target value of the ratio of the conveyance speeds (belt conveyance speed Vb/sheet conveyance speed Vf) in intermediate transfer belt 41 and sheet P, changes.

For example, backup roller 62 expands and its apparent radius increases when the temperature is relatively high. At this point, in image formation apparatus 101, target speed ratio Abf is a relatively large value. On the other hand, backup roller 62 contracts and the apparent radius decreases when the temperature is relatively low. At this point, in image formation apparatus 101, target speed ratio Abf is a relatively small value. In this way, in image formation apparatus 101, an appropriate value of target speed ratio Abf changes according to the temperature change of backup roller 62.

Therefore, controller 105 causes storage 105M to store in advance a target speed ratio table that associates the temperature of backup roller 62 and a value of target speed ratio Abf. Then, controller 105 detects the temperature of backup roller 62 with temperature sensor 163 in the image formation processing and reads out target speed ratio Abf corresponding to the detected temperature from storage 105M and uses that read out target speed ratio Abf.

Figure 9:
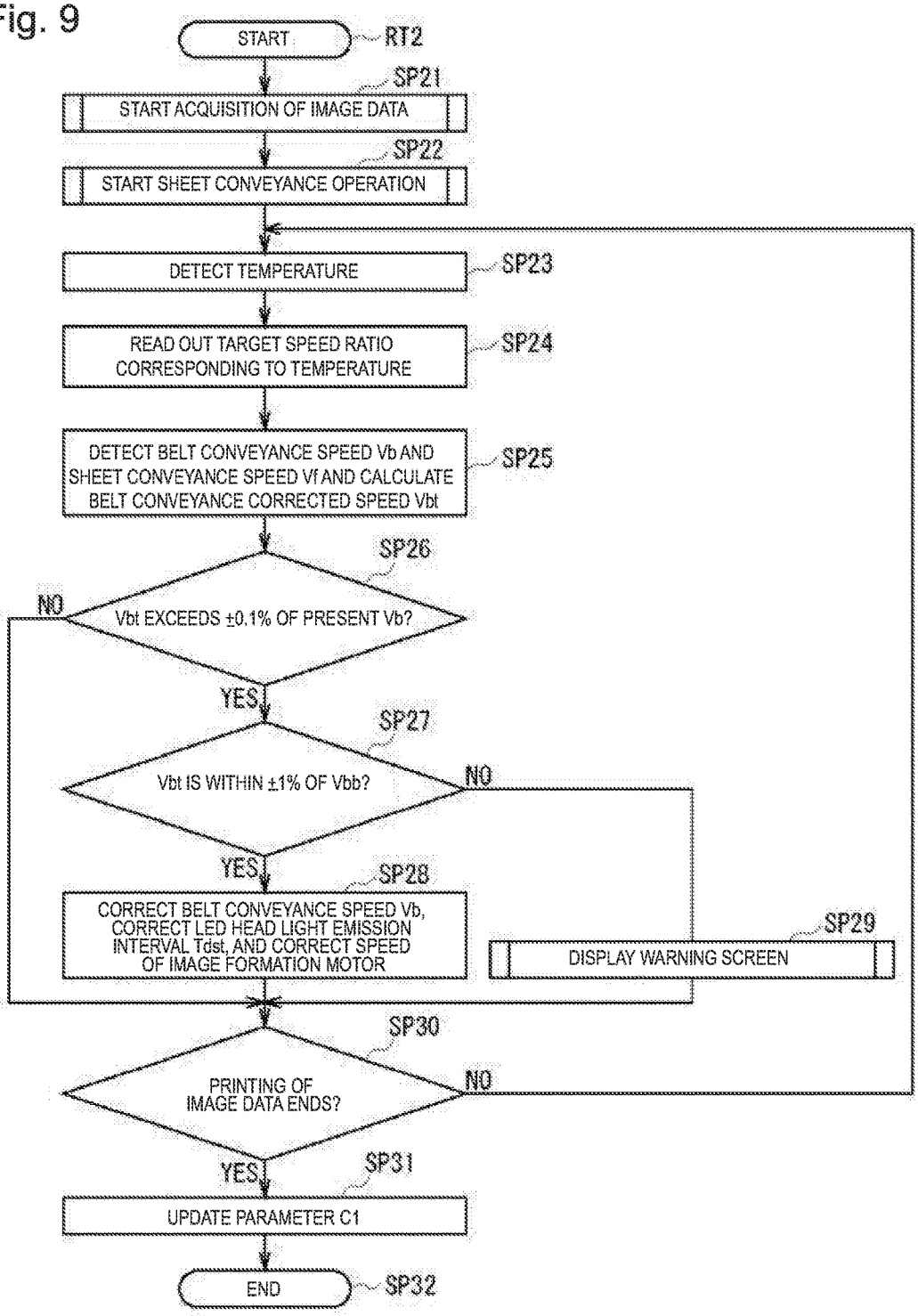
FIG. 9 is a flowchart for explaining an image formation processing procedure according to the second embodiment.

Specifically, when performing the image formation processing, controller 105 reads out an image formation program from storage 105M and executes the image formation program to thereby start image formation processing procedure RT2 illustrated in FIG. 9 instead of image formation processing procedure RT1 (FIG. 6) in the first embodiment, and shifts to step SP21.

In steps SP21 and SP22, controller 105 performs kinds of processing respectively the same as the kinds of processing in steps SP1 and SP2 and shifts to the next step SP23. In step SP23, controller 105 acquires the temperature detected by temperature sensor 163 and shifts to the next step SP24.

In step SP24, controller 105 reads out, from the target speed ratio table stored in storage 105M, target speed ratio Abf corresponding to the temperature detected in step SP23 and shifts to the next step SP25.

In step SP25, as in step SP3 of image formation processing procedure RT1 (FIG. 3), controller 105 detects belt conveyance speed Vb and sheet conveyance speed Vf respectively with image conveyance speed sensor 48 (FIG. 1) and sheet conveyance speed sensor 58 and calculates belt conveyance corrected speed Vbt according to Expression (7) described above. However, at this point, controller 105 calculates belt conveyance corrected speed Vbt using target speed ratio Abf read out from storage 105M in step SP24, that is, corresponding to the detected temperature.

Therefore, in steps SP26 to SP31, controller 105 performs kinds of processing respectively the same as the kinds of processing in steps SP4 to SP9 of image formation processing procedure RT1 (FIG. 3), shifts to the next step SP3, and ends image formation processing procedure RT2.

In the configuration explained above, as in the first embodiment, after starting the print processing of image data, controller 105 of image formation apparatus 101 according to the second embodiment acquires sheet conveyance speed Vf and calculates belt conveyance corrected speed Vbt using target speed ratio Abf. At this point, controller 105 can calculate, by using target speed ratio Abf corresponding to the temperature detected by temperature sensor 163, belt conveyance corrected speed Vbt that takes into account the expansion or contraction corresponding to the temperature of backup roller 62 and is more accurate than belt conveyance corrected speed Vbt in the first embodiment.

Thereafter, as in the first embodiment, controller 105 controls the rotating speed of belt motor 47 and corrects belt conveyance speed Vb to belt conveyance corrected speed Vbt. Consequently, image formation apparatus 101 can transfer, in secondary transfer section 60, the toner image from lower surface 41U (FIG. 5) of intermediate transfer belt 41 onto sheet P, the speeds of which substantially coincide with each other, more accurately than in the first embodiment without extending or compressing the toner image in the conveying direction.

In other points, image formation apparatus 101 according to the second embodiment can achieve the same action and effects as the action and effects of image formation apparatus 1 according to the first embodiment.

According to the configuration explained above, after starting the print processing of the image data, controller 105 of image formation apparatus 101 acquires sheet conveyance speed Vf and acquires the temperature in the vicinity of backup roller 62 and calculates belt conveyance corrected speed Vbt using target speed ratio Abf corresponding to the temperature. Subsequently, controller 105 controls the rotating speed of belt motor 47 and corrects belt conveyance speed Vb to belt conveyance corrected speed Vbt. Consequently, during the execution of the print processing, image formation apparatus 101 can match belt surface conveyance speed Vb' with sheet conveyance speed Vf in the vicinity of secondary transfer device 60, and highly accurately transfer the toner image from intermediate transfer belt 41 onto sheet P, and thereby realize a high-quality printing.

3. Other Embodiments

Note that, in the first embodiment, taking into account the fact that intermediate transfer belt 41 bends along the outer circumferential surface of backup roller 62 (FIG. 5), belt conveyance speed Vb is corrected to match belt surface conveyance speed Vb', which is the speed on lower surface 41U rather than in center line 41C, with sheet conveyance speed Vf. However, the invention is not limited to this. For example, when a difference between belt conveyance speed Vb and belt surface conveyance speed Vb' is a little (is small), belt conveyance speed Vb may be corrected to the same value as sheet conveyance speed Vf. The same applies to the second embodiment.

In the first embodiment, image conveyance speed sensor 48 is disposed in the place where intermediate transfer belt 41 linearly travels. Image conveyance speed sensor 48 detects belt conveyance speed Vb. However, the invention is not limited to this. For example, belt surface conveyance speed Vb' may be directly detected by setting the radius and the material of transfer-belt drive roller 43 the same as the radius and the material of backup roller 62 and detecting the conveyance speed of intermediate transfer belt 41 at the surface of intermediate transfer belt 41 bent by transfer-belt drive roller 43. The same applies to the second embodiment.

Further, in the first embodiment, in the vicinity of secondary transfer device 60, sheet P is linearly conveyed and intermediate transfer belt 41 is caused to travel so to bend along the circumferential side surface of backup roller 62. However, the invention is not limited to this. For example, in the vicinity of secondary transfer device 60, sheet P may be advanced to bend along the circumferential side surface of secondary transfer roller 61 and intermediate transfer belt 41 may be linearly advanced. In this case, belt conveyance corrected speed Vbt only has to be calculated by taking into account the speed of the surface of sheet P obtained on the basis of the radius of secondary transfer roller 61 and the thickness of sheet P. Alternatively, for example, in the vicinity of secondary transfer device 60, sheet P may be advanced to bend along the circumferential surface of secondary transfer roller 61 and intermediate transfer belt 41 may be caused to travel to bend along the circumferential side surface of backup roller 62. In this case, by appropriately setting the radiuses of secondary transfer roller 61 and backup roller 62, it is possible to match a ratio of belt conveyance speed Vb and sheet conveyance speed Vf with a ratio of the speed of the surface of intermediate transfer belt 41 and the speed of the surface of sheet P, and simplify the arithmetic processing. The same applies to the second embodiment.

In the first embodiment, sheet conveyance speed sensor 58 is disposed on the back side of conveyance roller pair 51C and slightly on the front side of secondary transfer device 60. However, the invention is not limited to this. Sheet conveyance speed sensor 58 may be disposed in other various places such as a place between conveyance roller pair 51B and conveyance roller pair 51C. In these cases, in short, the conveyance speed of sheet P only has to be able to be detected. However, it is desirable to detect a value as close as possible to the conveyance speed of sheet P in secondary transfer position Q by disposing sheet conveyance speed sensor 58 as close as possible to secondary transfer device 60. The same applies to the second embodiment.

In the first embodiment, sheet conveyance speed sensor 58 is disposed on the lower side of the conveyance path of sheet P. However, the invention is not limited to this. Sheet conveyance speed sensor 58 may be disposed, for example, on the upper side of the conveyance path of sheet P. In this case, the image sensor only has to be disposed on the lower side, which is the sheet P side. Consequently, it is possible to theoretically eliminate deposition of toner particles and the like on the image sensor and a cover and the like that protect the image sensor. This makes it possible to maintain a high detection accuracy of sheet conveyance speed Vf.

In the first embodiment, the image sensors are mounted on image conveyance speed sensor 48 and sheet conveyance speed sensor 58 and the conveyance speed of the toner image or sheet P is detected on the basis of images picked up at predetermined time intervals. However, the invention is not limited to this. Sensors corresponding to well-known various speed detecting methods may be mounted on image conveyance speed sensor 48 and sheet conveyance speed sensor 58 and the conveyance speed may be detected according to the speed detecting methods. Sensors corresponding to speed detecting methods different from each other may be respectively mounted on image conveyance speed sensor 48 and sheet conveyance speed sensor 58. The same applies to the second embodiment.

In the first embodiment, image conveyance speed sensor 48 picks up the toner image on intermediate transfer belt 41 and detects the speed of the toner image. However, the invention is not limited to this. For example, image conveyance speed sensor 48 may detect the speed of the surface itself of intermediate transfer belt 41. Alternatively, a mark, unevenness, and the like may be formed outside a range in which the toner image is formed and images of the mark, the unevenness, and the like may be picked up to detect the conveyance speed of the mark, the unevenness, and the like. The same applies to the second embodiment.

In the first embodiment, belt conveyance speed Vb is corrected when belt conveyance corrected speed Vbt exceeds the range of ±0.1% from the present belt conveyance speed Vb in step SP4 and the like of image formation processing procedure RT1 (FIG. 6). However, the invention is not limited to this. Belt conveyance speed Vb may be corrected when other various conditions, such as a condition that belt conveyance corrected speed Vbt deviates to outside a range of ±0.01% from the present belt conveyance speed Vb, are satisfied. Alternatively, belt conveyance speed Vb may be corrected irrespective of a relation between belt conveyance corrected speed Vbt and present belt conveyance speed Vb. The same applies to the second embodiment.

In the first embodiment, belt conveyance speed Vb is corrected when belt conveyance corrected speed Vbt is within the range of ±1% of belt conveyance reference speed Vbb in step SP5 and the like of image formation processing procedure RT1 (FIG. 6). However, the invention is not limited to this. Belt conveyance speed Vb may be corrected when other various conditions, such as a condition that belt conveyance corrected speed Vbt is within a range of ±2% of belt conveyance reference speed Vbb, are satisfied. The warning screen may not be displayed on the display 6 when these conditions are not satisfied. Alternatively, belt conveyance speed Vb may be corrected irrespective of a relation between belt conveyance corrected speed Vbt and belt conveyance reference speed Vbb. The same applies to the second embodiment.

In the first embodiment, the values of LED head light emission interval Tdst and photosensitive drum speed Vd are corrected when belt conveyance speed Vb is corrected in step SP6 of image formation processing procedure RT1 (FIG. 6). However, the invention is not limited to this. For example, a value of photosensitive drum speed Vd may not be corrected when a relation with belt conveyance speed Vb after correction, for example, a speed ratio, a speed difference, or the like, is within a predetermined range. LED head light emission interval Tdst may not be corrected, for example, when a change amount in the case of the correction is smaller than a predetermined threshold. The same applies to the second embodiment.

Further, in the second embodiment, temperature sensor 163 is provided in secondary transfer device 60 to detect the temperature of backup roller 62, target speed ratio Abf corresponding to the detected temperature is read out from storage 105M, and belt conveyance corrected speed Vbt is calculated using target speed ratio Abf. However, the invention is not limited to this. A sensor for detecting a value representing an environment in the vicinity of backup roller 62 such as humidity may be provided. Belt conveyance corrected speed Vbt only has to be calculated using target speed ratio Abf depending on the value detected by the sensor.

In the second embodiment, controller 105 causes storage 105M to store the target speed ratio table that associates the temperature of backup roller 62 and a value of target speed ratio Abf. Controller 105 reads out and uses the target speed ratio Abf corresponding to the temperature detected by temperature sensor 163. However, the invention is not limited to this. Target speed ratio Abf corresponding to the temperature of backup roller 62 may be obtained by various methods, such as a method of obtaining target speed ratio Abf by creating in advance a function representing a relation between a value of the temperature and a value of target speed ratio Abf and performing an arithmetic processing for applying the detected temperature to the function.

In the first embodiment, the invention is applied when image formation apparatus 1 forms an image (i.e., performs print processing) on a medium formed by long paper. However, the invention is not limited to this. The invention may be applied when images are formed on media formed in various shapes, such as cut paper of the A4 size and the like. In particular, the invention is effective, for example, when an image is formed on a "sturdy" medium such as thick paper and on a medium such as a slippery film having a smooth surface. In these cases, roll feeder unit 3 may be omitted and, instead of roll feeder unit 3, supply mechanisms and conveyance mechanisms suitable for the medium, such as a sheet cassette and a paper feeding mechanism, may be built in the lower side in main body section 2. Incidentally, when the cut paper of the thick paper is used as a medium, sheet conveyance speed sensor 58 is desirably set on the upstream side (i.e., the front side) of secondary transfer device 60 and within a range of distance Dmgn (FIG. 5). When sheet conveyance speed sensor 58 is set outside the range, it is likely that an accurate sheet conveyance speed Vf cannot be detected. The same applies to the second embodiment.

In the first embodiment, primary transfer sections 21 (21Y, 21M, 21C, and 21K) for the four colors are provided in image formation apparatus 1 and the toner images for the four colors are sequentially superimposed and carried on intermediate transfer belt 41. However, the invention is not limited to this. Primary transfer sections 21 for one to three or five or more colors may be provided in image formation apparatus 1. Toner images for the number of colors may be sequentially superimposed and carried on intermediate transfer belt 41. The same applies to the second embodiment.

In the first embodiment, the invention is applied to image formation apparatus 1, which is the electrophotographic printer. However, the invention is not limited to this. Image formation apparatus 1 may be applied to, for example, electrophotographic apparatuses such as a copying machine, and a facsimile apparatus, and a multifunction printer having functions of the two in combination. The same applies to the second embodiment.

The invention is not limited to the embodiments explained above and other embodiments. That is, the application range of the invention covers embodiments obtained by optionally combining a part or all of the embodiments and the other embodiments and embodiments obtained by extracting a part of the embodiments and the other embodiments.

In the first embodiment, image formation apparatus 1 includes intermediate transfer belt 41 functioning as the intermediate transfer belt, belt motor 47 functioning as the driver, secondary transfer device 60 functioning as the transfer device, image conveyance speed sensor 48 functioning as the first detector, controller 5 functioning as the controller, central conveyer section 50 functioning as the conveyer section, and sheet conveyance speed sensor 58 functioning as the second detector. However, the invention is not limited to this. The image formation apparatus may include an intermediate transfer belt, a driver, a transfer device, a first detector, a controller, a conveyer section, and a second detector having any of other various configurations.

The invention can be used in, for example, an electrophotographic image formation apparatus adopting a system for transferring a toner image onto a sheet via an intermediate transfer belt.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an intermediate transfer belt that carries a developer image formed by an image formation section;

a driver that drives the intermediate transfer belt in a predetermined direction;

a transfer device that transfers the developer image carried on the intermediate transfer belt onto a predetermined medium;

a first detector that detects a belt conveyance speed, which is a travel speed of the intermediate transfer belt;

a controller that controls the driver;

a conveyer section that conveys the medium to the transfer device; and a second detector that detects a medium conveyance speed, which is a speed of the medium conveyed by the conveyer section, wherein the controller controls the driver such that the travel speed of the intermediate transfer belt at the transfer device is adjusted to the detected medium conveyance speed.

2. The image formation apparatus according to claim 1, wherein the conveyer section includes a conveyance roller pair that is disposed upstream of and next to the transfer device on a conveyance path of the medium and transmits a driving force to the medium, and the second detector is disposed between the transfer device and the conveyance roller pair.

3. The image formation apparatus according to claim 1, wherein the second detector is disposed on an opposite surface side of the medium conveyed from the conveyer section, the opposite surface side being opposite to a surface of the medium onto which the developer image is transferred from the intermediate transfer belt.

4. The image formation apparatus according to claim 1, wherein at least one of the first detector and the second detector includes an image sensor and detects speed based on images picked up at predetermined time intervals.

5. The image formation apparatus according to claim 1, wherein the medium is a long sheet.

6. The image formation apparatus according to claim 5, further comprising a roll feeder unit including a roll holder that hold the long sheet in a rolled manner and configured to pull out the long sheet and feed the long sheet to the conveyer section.

7. The image formation apparatus according to claim 1, wherein the controller controls the driver to adjust the travel speed of the intermediate transfer belt without changing the medium conveyance speed after the second detector detects the medium conveyance speed.

8. The image formation apparatus according to claim 1, wherein the controller controls the conveyer section such that, in a course that the medium is transferred to the transfer section, the medium conveyance speed, which is the speed of the medium conveyed by the conveyer section, is set at a first speed, decreased to a second speed slower than the first speed, and then increased to a third speed faster then the second speed, wherein the third speed is detected by the second detector.

9. An image formation apparatus comprising:

an intermediate transfer belt that carries a developer image formed by an image formation section;

a driver that drives the intermediate transfer belt in a predetermined direction;

a transfer device that transfers the developer image carried on the intermediate transfer belt onto a predetermined medium;

a first detector that detects a belt conveyance speed, which is a travel speed of the intermediate transfer belt;

a controller that controls the driver;

a conveyer section that conveys the medium to the transfer device; and a second detector that detects a medium conveyance speed, which is a speed of the medium conveyed by the conveyer section, wherein at the transfer device where the developer image is to be transferred from the intermediate transfer belt to the medium, the intermediate transfer belt is bent, the first detector detects the belt conveyance speed in a place where the intermediate transfer belt linearly travels, and the controller controls the driver such that a belt surface conveyance speed, which is a travel speed of a surface of the intermediate transfer belt at the transfer device where the intermediate transfer belt is bent, is adjusted to the detected medium conveyance speed.

10. The image formation apparatus according to claim 9, wherein the controller calculates in advance a ratio between the belt surface conveyance speed and the medium conveyance speed, calculates a belt conveyance corrected speed, which is a target value to which the belt conveyance speed is to be corrected, based on the detected medium conveyance speed detected by the second detector and the ratio, and controls the driving of the driver such that the belt conveyance speed is adjusted to the belt conveyance corrected speed.

11. The image formation apparatus according to claim 10, further comprising an environment detector that detects an environment value corresponding to an environment around the transfer device, wherein the ratio is changed depending on the environment, and the controller calculates the belt conveyance corrected speed based on the ratio depending on the environment value detected by the environment detector.

12. The image formation apparatus according to claim 10, wherein, when the belt conveyance corrected speed exceeds a predetermined range from the belt conveyance speed, the controller controls the driving of the driver such that the belt conveyance speed is adjusted to the belt conveyance corrected speed.

13. The image formation apparatus according to claim 10, wherein, when the belt conveyance corrected speed is within a predetermined range from a predetermined reference speed, the controller controls the driving of the driver such that the belt conveyance speed is adjusted to the belt conveyance corrected speed.

* * * * *